US008832869B2

(12) United States Patent
Ma et al.

(10) Patent No.: US 8,832,869 B2
(45) Date of Patent: Sep. 16, 2014

(54) HELMET MASSAGER AND HELMET THEREOF

(75) Inventors: Xuejun Ma, Shenzhen (CN); Xuliang Wu, Shenzhen (CN); Tao Zhang, Shenzhen (CN); Yong Wan, Shenzhen (CN)

(73) Assignee: Shenzhen Breo Technology Co., Ltd., Shenzhen (CN)

( * ) Notice: Subject to any disclaimer, the term of this patent is extended or adjusted under 35 U.S.C. 154(b) by 478 days.

(21) Appl. No.: 13/143,487

(22) PCT Filed: Aug. 12, 2010

(86) PCT No.: PCT/CN2010/075928

§ 371 (c)(1),
(2), (4) Date: Jul. 6, 2011

(87) PCT Pub. No.: WO2011/050647

PCT Pub. Date: May 5, 2011

(65) Prior Publication Data

US 2011/0265254 A1 Nov. 3, 2011

(30) Foreign Application Priority Data

Nov. 2, 2009 (CN) ..... 2009 1 0221084

(51) Int. Cl.

| | |
|---|---|
| ***A42B 3/04*** | (2006.01) |
| ***A42B 3/14*** | (2006.01) |
| ***A61H 7/00*** | (2006.01) |

(52) U.S. Cl.

CPC ..... *A42B 3/145* (2013.01); *A61H 7/006* (2013.01)

USPC ..... 2/420; 2/418

(58) Field of Classification Search

USPC ..... 2/8.1, 10, 416–422

See application file for complete search history.

(56) References Cited

U.S. PATENT DOCUMENTS 2,205,741 A * 6/1940 Bowers ..... 2/8.1
2,205,742 A * 6/1940 Bowers ..... 2/8.1

(Continued)

FOREIGN PATENT DOCUMENTS

CN 200939230 8/2007
CN 101040815 9/2007

(Continued)

*Primary Examiner* — Richale Quinn

(74) *Attorney, Agent, or Firm* — Hamre, Schumann, Mueller & Larson, P.C.

(57) ABSTRACT

A helmet massager and a helmet thereof are provided. The helmet massager comprises a helmet. The helmet comprises a first helmet body. The first helmet body comprises a first left helmet body and a first right helmet body which are butt jointed. The first left helmet body and the first right helmet body respectively have a first left rack and a first right rack. The helmet further comprises an adjusting device. The adjusting device comprises a base, a gear, a ratchet body with ratchet teeth, and a knob for driving the ratchet body to rotate. The base is located at a butt-joint site of the first left helmet body and the first right helmet body. Each of the first left rack and the first right rack engages with the gear. The ratchet body is positioned on the gear. The knob is mounted on the ratchet body. The base has a ring of locking teeth. The ratchet body has a rotating state and a rest state. When it is desired to adjust a size of a head room, the knob is turned in a forward direction or a reverse direction so that, via the ratchet body, the gear is driven by the knob to rotate. In this way, two adjacent butt-joint ends are driven by the gear to move away from or close to each other to change the size of the head room.

21 Claims, 15 Drawing Sheets

(56) References Cited

U.S. PATENT DOCUMENTS

| | | | | |
|---|---|---|---|---|
| 2,926,406 | A * | 3/1960 | Zahnor et al. | 24/68 B |
| 3,214,809 | A * | 11/1965 | Zahnor | 24/68 B |
| 3,444,560 | A * | 5/1969 | Northup, Jr | 2/8.1 |
| 4,942,628 | A * | 7/1990 | Freund | 2/416 |
| 5,081,986 | A * | 1/1992 | In | 601/144 |
| 5,357,654 | A * | 10/1994 | Hsing-Chi | 24/68 B |
| 5,950,245 | A * | 9/1999 | Binduga | 2/417 |
| 6,125,477 | A * | 10/2000 | Crippa et al. | 2/422 |
| 6,314,588 | B1 * | 11/2001 | Fang | 2/418 |
| 6,708,376 | B1 * | 3/2004 | Landry | 24/68 R |
| 7,000,262 | B2 * | 2/2006 | Bielefeld | 2/418 |
| 7,174,575 | B1 * | 2/2007 | Scherer | 2/418 |
| 7,565,704 | B2 * | 7/2009 | Wu | 2/418 |
| 7,707,695 | B2 * | 5/2010 | Dubois | 24/68 B |
| 7,854,024 | B2 * | 12/2010 | Fang | 2/418 |
| 8,015,625 | B2 * | 9/2011 | Grim et al. | 2/420 |
| 8,056,150 | B2 * | 11/2011 | Stokes et al. | 2/417 |
| 8,161,576 | B2 * | 4/2012 | Lemke et al. | 2/418 |
| 8,296,868 | B2 * | 10/2012 | Belanger et al. | 2/420 |
| 8,359,672 | B2 * | 1/2013 | Moelker | 2/418 |
| 8,370,967 | B2 * | 2/2013 | Chen | 2/418 |
| 8,434,200 | B2 * | 5/2013 | Chen | 24/68 SK |
| 2006/0225187 | A1 * | 10/2006 | Wu | 2/425 |
| 2008/0295229 | A1 * | 12/2008 | Fang | 2/418 |
| 2010/0095438 | A1 * | 4/2010 | Moelker | 2/418 |
| 2011/0265254 | A1 * | 11/2011 | Ma et al. | 2/420 |

FOREIGN PATENT DOCUMENTS

| | | |
|---|---|---|
| CN | 101045028 | 10/2007 |
| CN | 200970326 | 11/2007 |
| CN | 200977266 | 11/2007 |
| CN | 101564211 | 10/2009 |
| WO | 2007/025500 | 3/2007 |

* cited by examiner

HELMET MASSAGER AND HELMET THEREOF

BACKGROUND OF THE INVENTION

1. Technical Field

The present invention relates to a health massage apparatus, and more particularly, to a helmet massager and a helmet thereof.

2. Description of Related Art

A head massager that is currently available has a helmet and a massage device such as a device for providing massage by using expansion and contraction of an air bladder, a device for providing massage by using a magnetic force, a device for providing massage using a cold compress or a hot compress, or a device for providing massage using eccentric vibrations generated by a vibrating motor. When the head massager is used, a person puts the helmet on his head and uses the massage device mounted on the helmet to massage his head, ocular regions or acupoints. However, this massager suffers from the following disadvantage: the helmet has a fixed head room, which may be too large or too small for some of different users, so the users may feel uneasy when wearing the helmet.

BRIEF SUMMARY OF THE INVENTION

A technical problem to be solved by the present invention is to overcome the shortcomings of the prior art and provide a helmet massager whose helmet is adjustable in size and a helmet thereof.

The present invention adopts the following technical solutions to solve the technical problem: a helmet massager comprising a helmet, the helmet comprising a first helmet body, wherein the first helmet body comprises a first left helmet body and a first right helmet body which are butt jointed, the first left helmet body and the first right helmet body respectively have a first left butt-joint end and a first right butt-joint end, the first left butt joint end and the first right butt-joint end respectively have a first left rack and a first right rack, the helmet further comprises an adjusting device, the adjusting device comprises a base, a gear, a ratchet body with ratchet teeth, and a knob for driving the ratchet body to rotate, the base is located at a butt-joint site of the first left helmet body and the first right helmet body, each of the first left rack and the first right rack engages with the gear, the ratchet body is positioned on the gear, the knob is mounted on the ratchet body, the base has a ring of locking teeth, the ratchet body has a rotating state and a rest state, when the ratchet body is in the rest state, the ratchet teeth engage with the locking teeth, and when the ratchet body is in the rotating state, the ratchet teeth are disengaged from the locking teeth. The base may be integrally formed with the butt-joint site, or may be disposed independently from the butt-joint site and fixedly and integrally connected with the butt-joint site in a known way.

Further, the ratchet body comprises a body and an elastic arm cantilevering from the body and having an elasticity, and the ratchet teeth are disposed on the elastic arm.

Further, each of the ratchet teeth has a first bevel, and each of the locking teeth has a second bevel matching the first bevel.

Further, one of the knob and the ratchet body has a poke rod, the other one of the knob and the ratchet body has an arcuate adjusting groove, the poke rod extends into the adjusting groove, and the poke rod has an outer diameter that is less than a length of the adjusting groove.

Further, the gear is formed with a snapping groove at a side facing the ratchet body, the ratchet body is provided with a snapping post at a side facing the gear, and the snapping post is snap-fitted into the snapping groove.

Further, the adjusting device further comprises a rotary shaft axially positioned on the base, and the gear, the ratchet body and the knob are all disposed around the rotary shaft.

Further, the knob comprises a knob body and a knob cover, the knob cover is disposed around and fixedly and integrally connected with the knob body, and the knob cover is made of a soft rubber. Through installation of the knob cover, the friction damping during the turning operation can be increased to provide a good operation feel.

Further, the knob cover and the knob body are injection molded into one piece.

Further, the knob cover and the knob body engage with each other by means of a groove and a protrusion.

Further, the first left helmet body is provided with a cloth cover on an inner side thereof, the cloth cover comprises a cloth cover body and linings, the cloth cover body is covered with an air bladder, the cloth cover body has through-holes corresponding to a user's eyeballs, each of the linings has an opening corresponding to one of the through-holes, and an edge of each of the openings is sewn up with an edge of one of the through-holes.

Further, the linings are located inside the cloth cover body.

Further, each of the through-holes corresponds to two linings, and an edge of each of the openings of the two linings is sewn up with an edge of one of the through-holes.

Further, the first right helmet body comprises an inner shell, an outer shell and a screw, the inner shell comprises a via hole, the outer shell comprises a screw hole, and the screw is inserted through the via hole and then locked into the screw hole. By providing the screw at a side of the inner shell, the outer shell facing a user can be made neat and artistic.

Further, the via hole has a stepped surface, against which a head of the screw abuts.

Further, the outer shell comprises a locating post in which the screw hole is located, and the locating post is inserted into the via hole.

Further, the via hole has a stepped surface, the screw has a bolt with a smaller outer diameter and a head with a larger outer diameter, the bolt is inserted through the via hole and then locked into the screw hole, and the head abuts against the stepped surface.

Further, the via hole comprises a first hole, a second hole and a third hole which run into one another sequentially, both an aperture of the first hole and an aperture of the third hole are larger than an aperture of the second hole, the locating post is inserted into the third hole, and the stepped surface is formed at an interface of the first hole and the second hole.

Further, the inner shell is fixedly provided with a cloth cover and a supporting plate, the cloth cover covers the supporting plate, the supporting plate comprises a fixed portion and two foldable portions, the fixed portion is fixed to the inner shell, the two foldable portions are disposed at two ends of the fixed portion respectively, the fixed portion is integrally connected with the foldable portions, and the foldable portions are capable of bending relative to the fixed portion.

Further, the ratchet body and the gear rotate synchronously, and the ring of locking teeth of the base surrounds a rotation axis of the gear. The number of the locking teeth may be designed according to requirements of a locking position. Synchronous rotation means that the ratchet body is capable of rotating synchronously with the gear.

Further, the helmet further comprises a second helmet body disposed on the first helmet body.

Further, the base comprises a base body and an enclosure, the base body and the enclosure are fixedly connected with each other to enclose a butt-joint space, and the first left butt-joint end and the first right butt-joint end are inserted into the butt-joint space from a left side and a right side respectively.

A helmet massager comprising a helmet, the helmet comprising a first helmet body and a second helmet body connected across the first helmet body, wherein the first helmet body comprises a first left helmet body and a first right helmet body which are butt jointed, the second helmet body comprises a second left helmet body and a second right helmet body which are butt jointed, each of the first left helmet body, the first right helmet body, the second left helmet body and the second right helmet body has a butt-joint end, each of the butt-joint ends has a rack, two adjacent butt-joint ends are butt jointed by means of an adjusting device, the adjusting device comprises a base, a gear, a ratchet body and a knob for driving the ratchet body to rotate, the base is located at a butt-joint site of two adjacent butt-joint ends, each of the racks of the two adjacent butt-joint ends engages with the gear, the ratchet body is positioned on the gear, the ratchet body has an elastic portion which is deformed when being stressed, the elastic portion is formed with ratchet teeth, the knob is mounted on the ratchet body, the base has a ring of locking teeth, the ratchet body has a rotating state and a rest state, when the ratchet body is in the rest state, the ratchet teeth engage with the locking teeth, and when the ratchet body is in the rotating state, the locking teeth deform the elastic portion so that the ratchet teeth are disengaged from the locking teeth.

A helmet of a helmet massager, the helmet comprising a first helmet body, wherein the first helmet body comprises a first left helmet body and a first right helmet body which are butt jointed, the first left helmet body and the first right helmet body respectively have a first left butt-joint end and a first right butt-joint end, the first left butt-joint end and the first right butt joint end respectively have a first left rack and a first right rack, the helmet further comprises an adjusting device, the adjusting device comprises a base, a gear, a ratchet body with ratchet teeth, and a knob for driving the ratchet body to rotate, the base is located at a butt-joint site of the first left helmet body and the first right helmet body, each of the first left rack and the first right rack engages with the gear, the ratchet body is positioned on the gear, the knob is mounted on the ratchet body, the base has a ring of locking teeth, the ratchet body has a rotating state and a rest state, when the ratchet body is in the rest state, the ratchet teeth engage with the locking teeth, and when the ratchet body is in the rotating state, the ratchet teeth are disengaged from the locking teeth.

The present invention has the following benefits: when it is desired to adjust a size of the head room, the knob is turned in a forward direction or a reverse direction so that, via the ratchet body, the gear is driven by the knob to rotate, and in this way, two adjacent butt-joint ends are driven by the gear to move away from or close to each other to increase or decrease the size of the head room, thereby adapting the massager to head forms of different users; as the ratchet body is provided, the gear is driven by the ratchet body to rotate when the knob is turned; and when the knob is not turned, the ratchet body engages with the base, accomplishing self-locking of the whole adjusting device to prevent improper rotation of the gear.

DETAILED DESCRIPTION OF THE INVENTION

Figure 1:
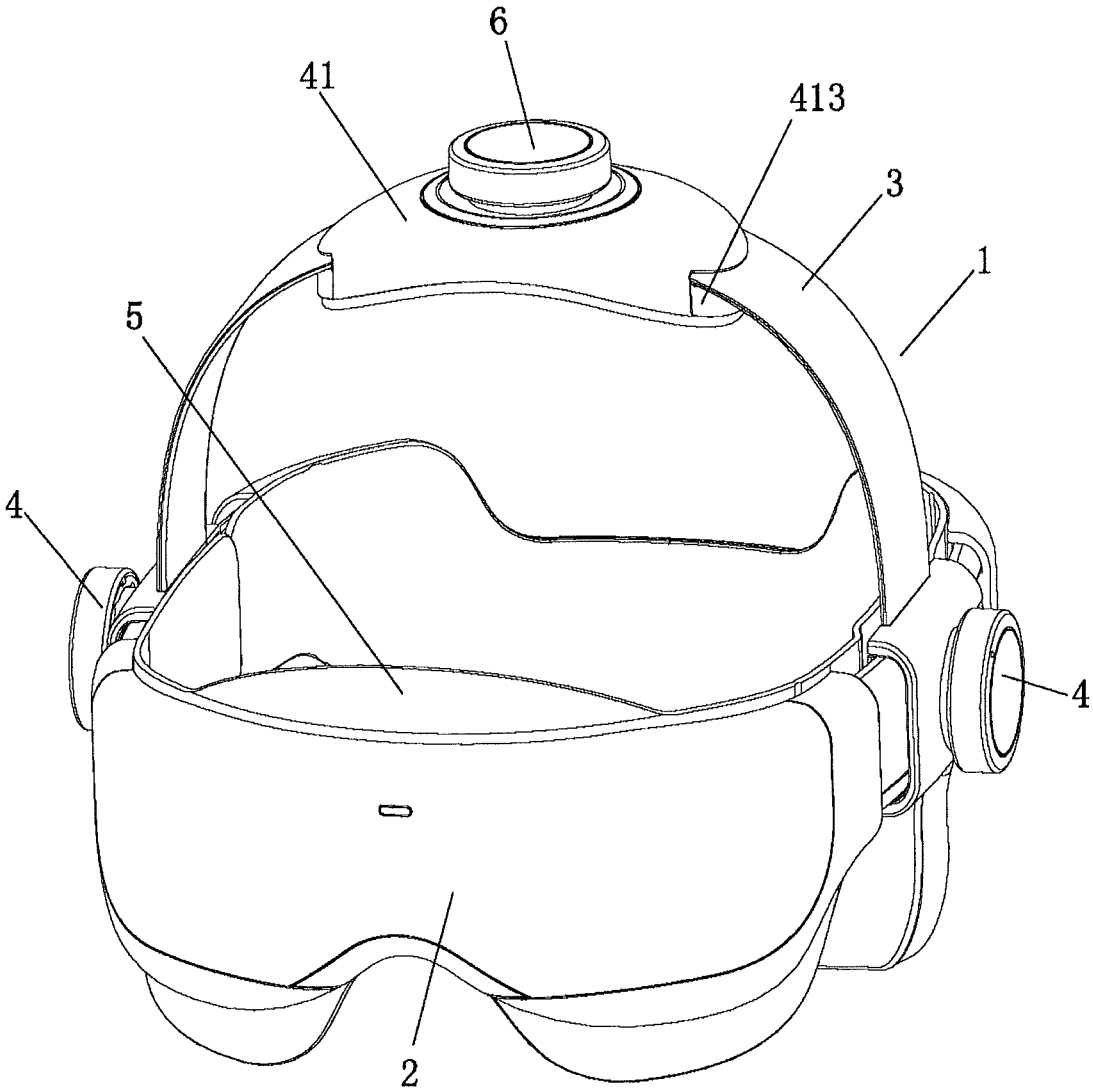
FIG. 1 is a perspective view of a helmet massager of an embodiment.
Figure 2:
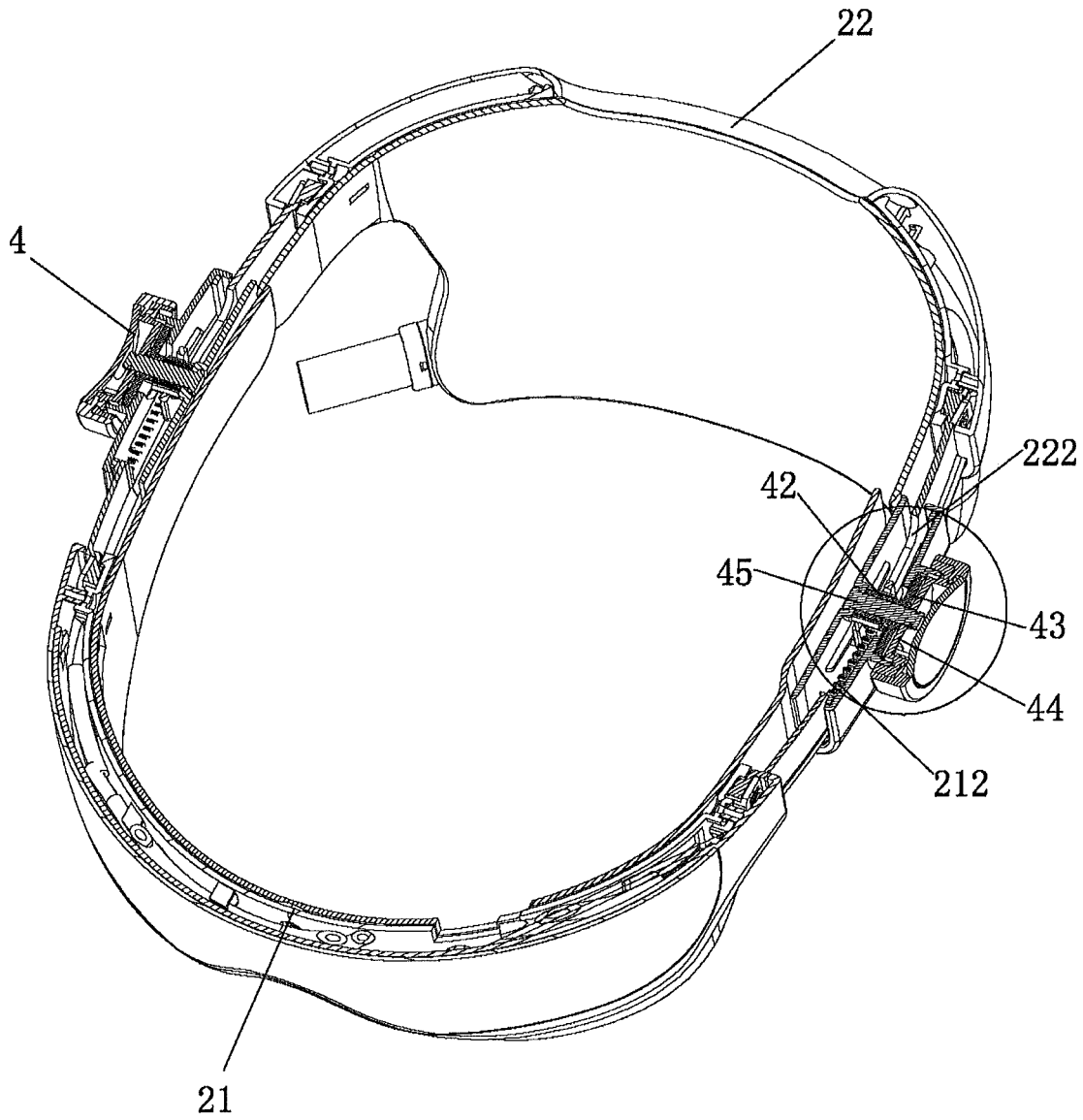
FIG. 2 is a schematic cross-sectional view reflecting a connection relationship between a first helmet body and a first adjusting device of the helmet massager of the embodiment.
Figure 3:
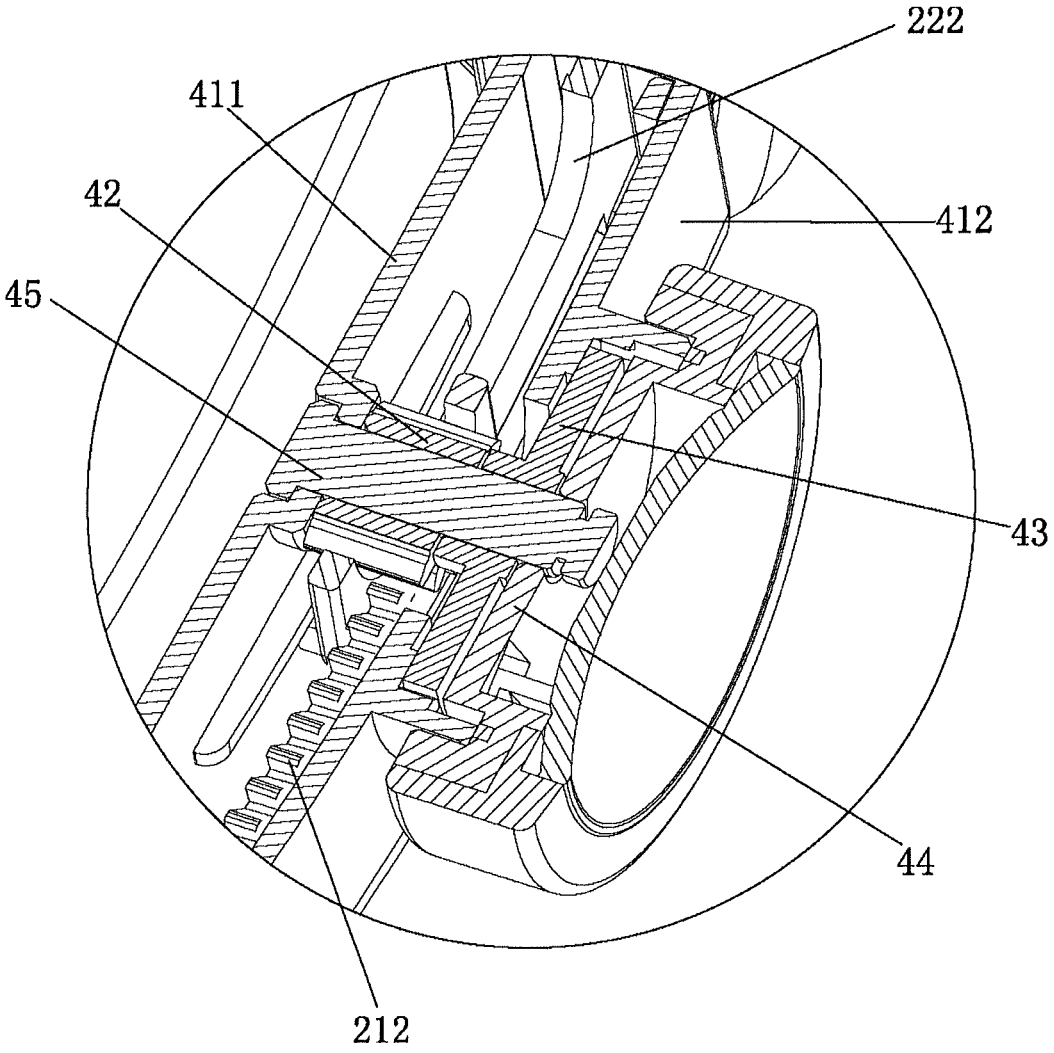
FIG. 3 is a partial enlarged view of a part pointed by P in FIG. 2.
Figure 4:
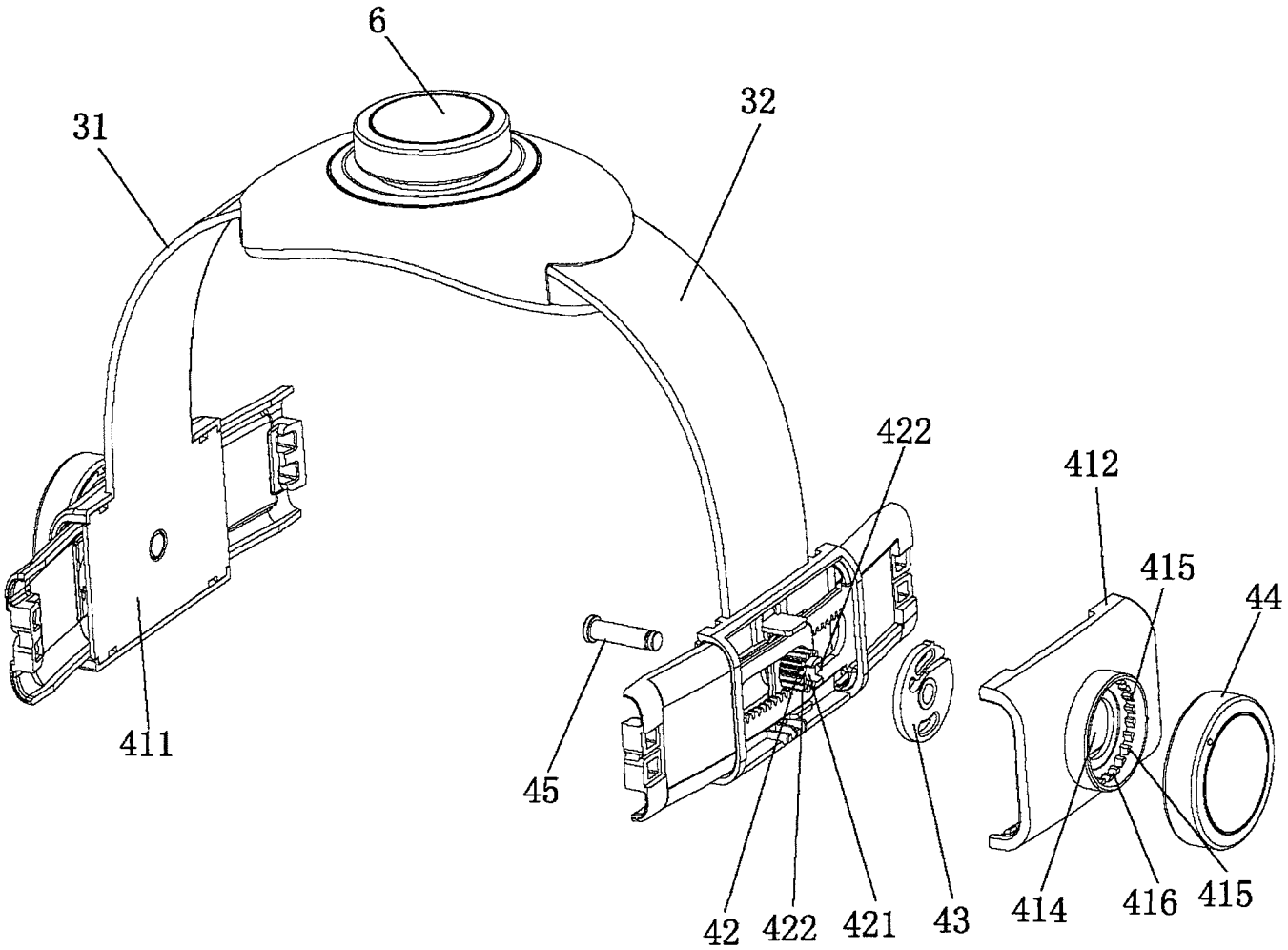
FIG. 4 and FIG. 5 are schematic perspective exploded views of the helmet massager of the embodiment when being viewed from two different viewing angles respectively.
Figure 5:
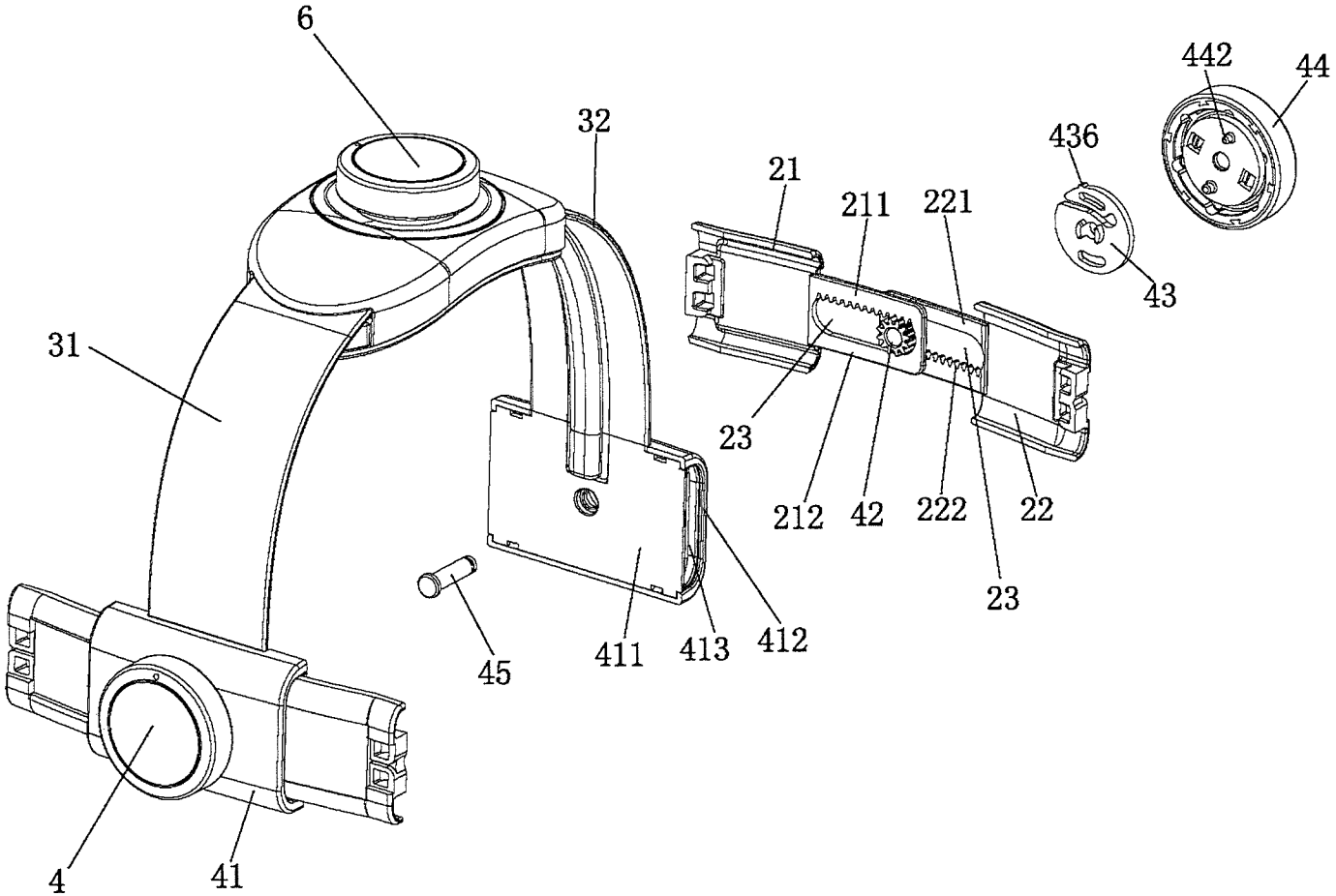
Figure 6:
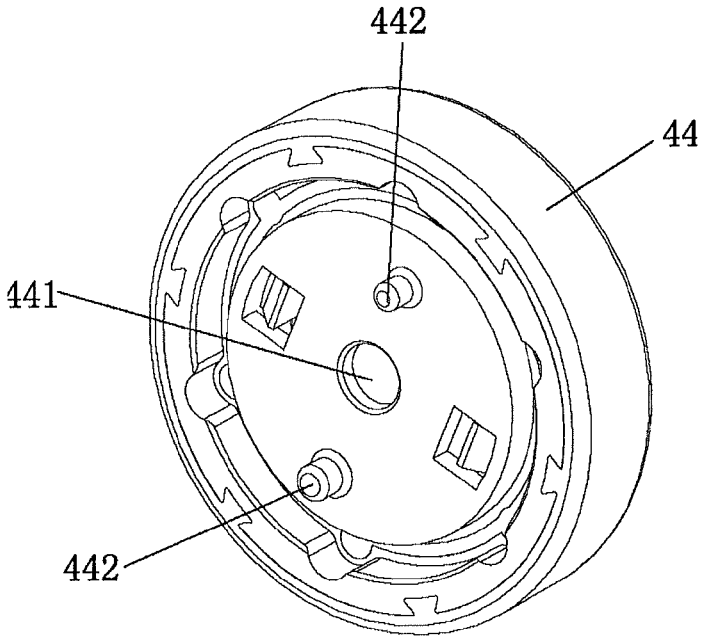
FIG. 6 is a perspective view of a knob of the helmet massager of the embodiment.
Figure 7:
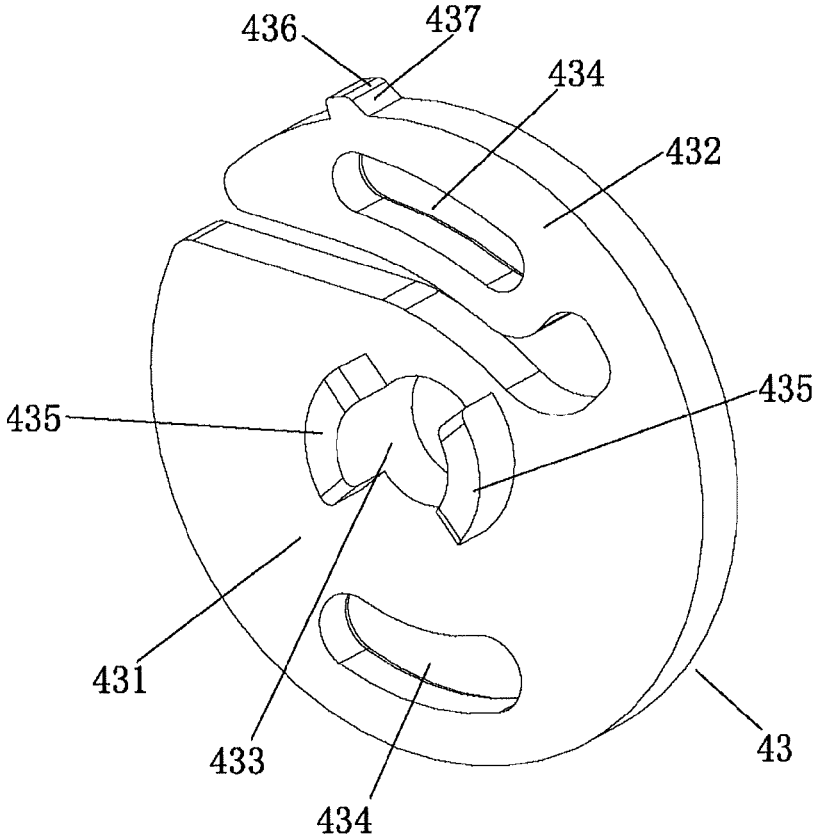
FIG. 7 is a perspective view of a ratchet body of the helmet massager of the embodiment.

As shown in FIG. 1 to FIG. 10, a helmet massager of an embodiment comprises a helmet 1, which is worn on a head of a person. The helmet 1 comprises a circular first helmet body 2 and an arcuate second helmet body 3 mounted on the first helmet body 2. The first helmet body 2 is covered on the head circumference of the person, the second helmet body 3 is covered on the top of the head of the person, and the first helmet body 2 and the second helmet body 3 enclose a head room 5.

The first helmet body 2 comprises a first left helmet body 21 and a first right helmet body 22 which are butt jointed. Both ends of the first left helmet body 21 are a first left butt-joint end 211, and each of the first left butt joint ends 211 has a first left rack 212. Both ends of the first right helmet body 22 are a first right butt-joint end 221, and each of the first right butt-joint ends 221 has a first right rack 222. The two first left butt-joint ends 212 are butt jointed with the two first right butt-joint ends 222 by means of two first adjusting device 4.

Each of the first adjusting device 4 comprises a base 41, a gear 42, a ratchet body 43, a knob 44 and a rotary shaft 45. The base 41 comprises a base body 411 and an enclosure 412 which are fixedly connected with each other, and the base body 411 and the enclosure 412 form a butt-joint space 413 therebetween. The first left butt-joint end 211 and the first right butt joint end 221 are inserted into the butt-joint space 413 from a left side and a right side respectively. The two base bodies 411 are fixed at two ends of the second helmet body 3 respectively. The base bodies may be formed independently from or integrally with the second helmet body.

The enclosure 412 has a through-hole 414 running therethrough, the through-hole 414 has a ring of locking teeth 415 protruded from a wall thereof, and each of the locking teeth 415 has a second bevel 416. The number of the locking teeth 415 may be determined according to design requirements.

The gear 42 engages with both the first left rack 212 and the first right rack 222 so that the gear 42 constitutes a gear-rack structure together with the first left helmet body 21 and the first right helmet body 22 respectively. The gear 42 has a first axle hole 421 running therethrough, and the gear 42 is formed with a snapping groove 422 at a side facing the ratchet body 43. Each of the first left rack 212 and the first right rack 222 may have a rack groove 23, the gear 42 is located in the two rack grooves 23, and a length of each of the rack grooves 23 is larger than an outer diameter of the gear 42.

The ratchet body 43 comprises a body 431 and an elastic arm 432 cantilevering from the body 431 and having an elasticity. The body 431 is formed with a second axle hole 433 and an arcuate adjusting groove 434 which run therethrough. The body 431 has a snapping post 435 protruded at a side facing the gear 42, and the snapping post 435 matches the snapping groove 422 in one-to-one correspondence. The elastic arm 432 is also formed with an arcuate adjusting groove 434 running therethrough. The elastic arm 432 has ratchet teeth 436, and each of the ratchet teeth 436 has a first bevel 437 matching the second bevel 416.

The knob 44 has a third axle hole 441, and is provided with two poke rods 442 at a side facing the ratchet body 43. The two poke rods 442 correspond to the two adjusting grooves 434 respectively. Each of the two poke rods 442 has an outer diameter that is less than a length of each of the two adjusting grooves 434 so that each of the poke rods 442 can move in the corresponding one of the adjusting grooves 434.

In the assembling process, the two poke rods 442 are inserted into the two adjusting grooves 434 so that the knob 44 is installed on and linked with the ratchet body 43. The snapping post 435 is snap-fitted into the snapping groove 422 so that the ratchet body 43 is positioned on the gear 42 and can drive the gear 42 to rotate. The first left rack 212 and the first right rack 222 are distributed at an upper position and a lower position respectively and the gear 42 is located between and engages with the first left rack 212 and the first right rack 222 so that the gear 42 can drive the first left helmet body 21 and the first right helmet body 22 to move. The rotary shaft 45 cooperates with the first axle hole 421, the second axle hole 433 and the third axle hole 441 so that the gear 42, the ratchet body 43 and the knob 44 can rotate about the same axis, and two ends of the rotary shaft 45 are snap-fitted into the base 41 and the knob 44 respectively to prevent the rotary shaft 45 from falling off easily.

Figure 8:
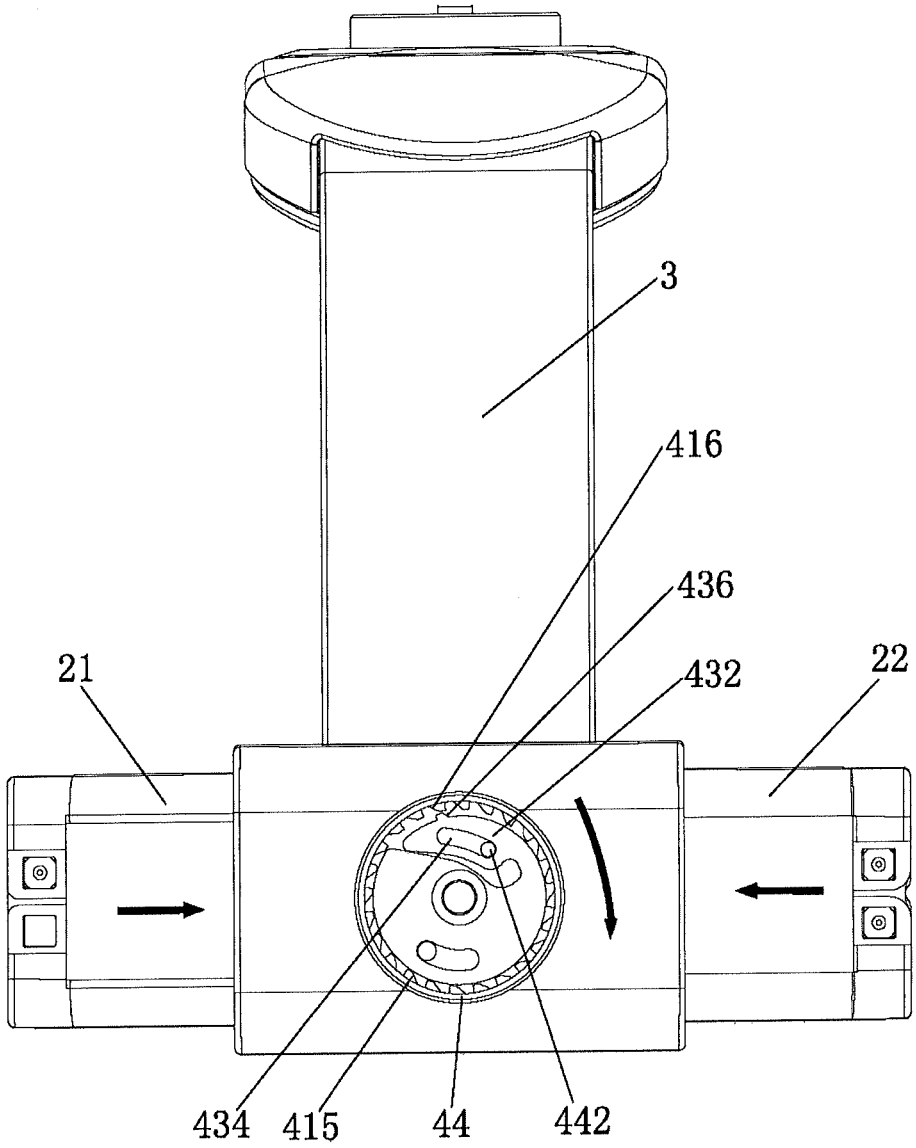
FIG. 8 is a schematic structure view of the knob of the helmet massager of the embodiment when being turned in a forward direction.
Figure 9:
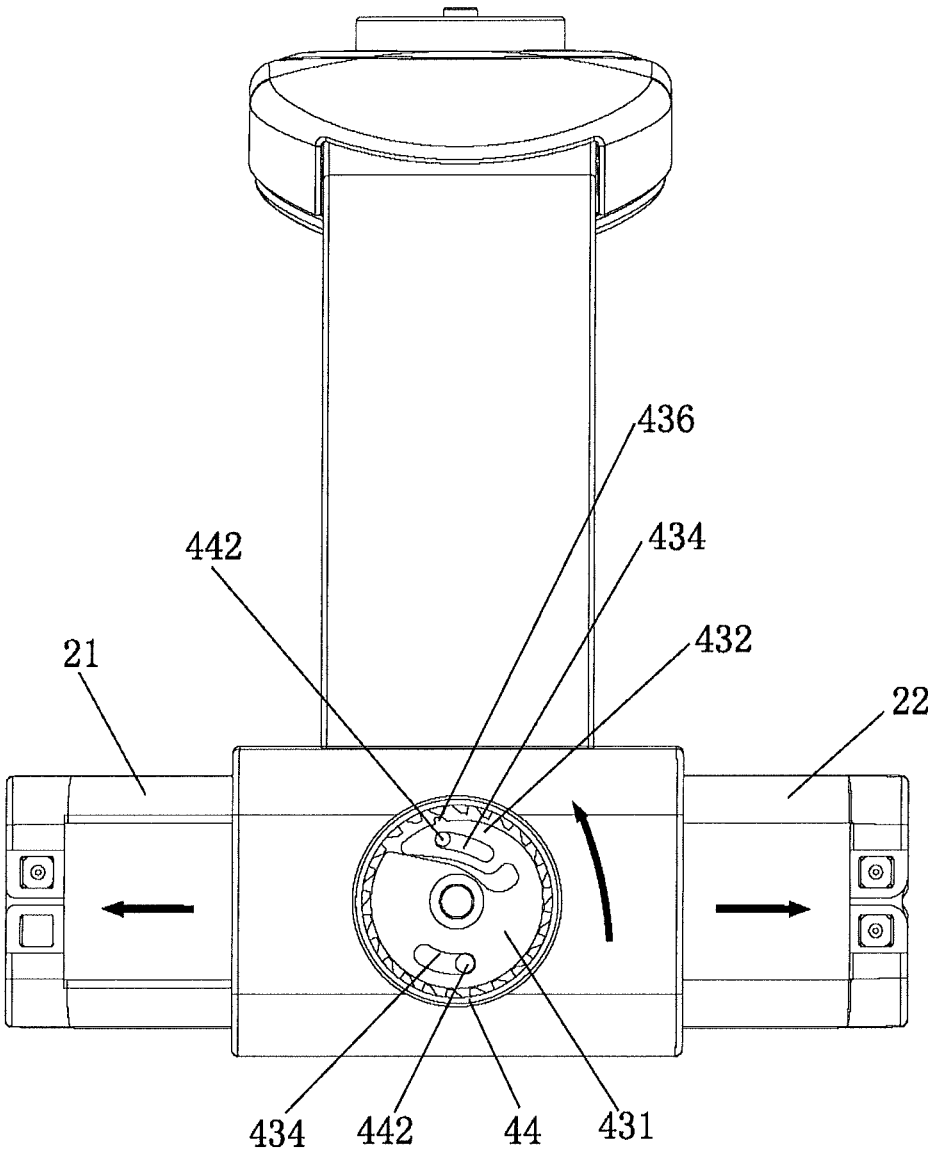
FIG. 9 is a schematic structure view of the knob of the helmet massager of the embodiment when being turned in a reverse direction.
Figure 10:
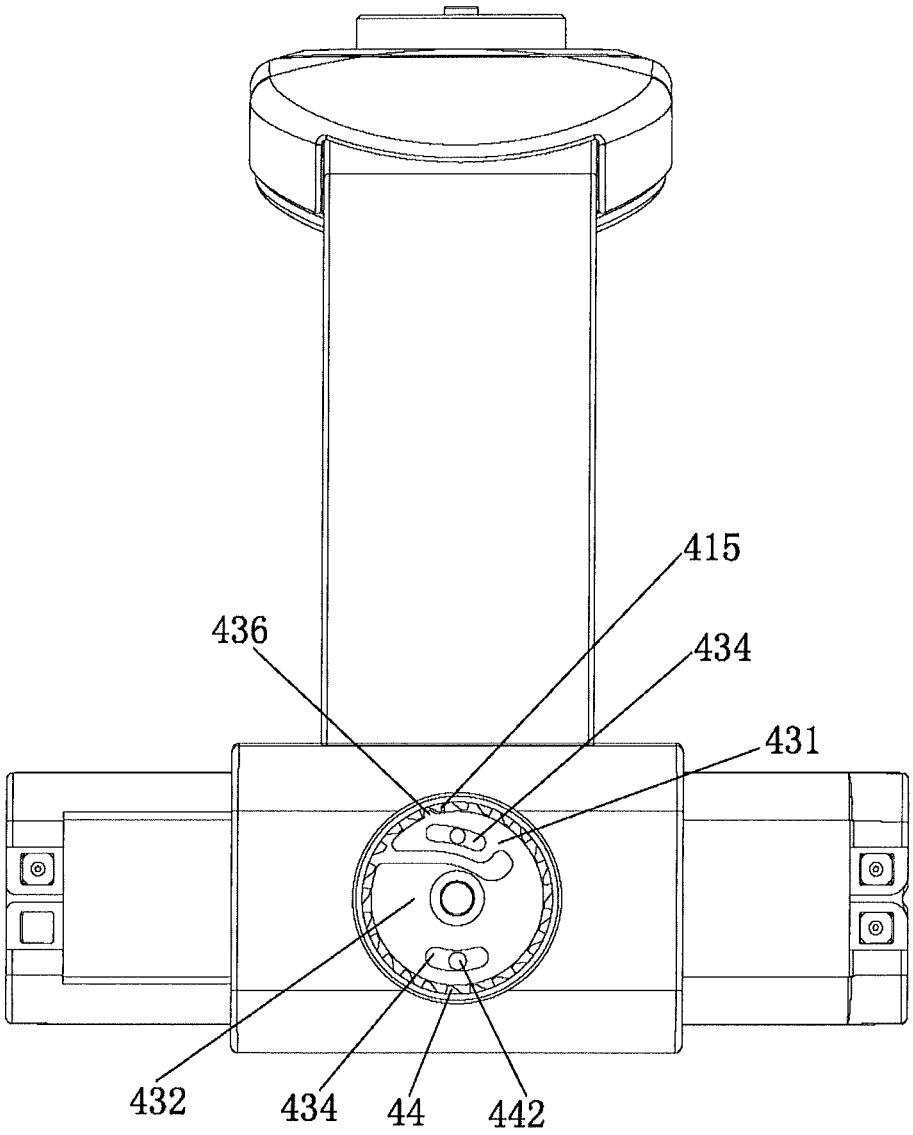
FIG. 10 is a schematic structure view of the knob of the helmet massager of the embodiment which is not turned.
Figure 11:
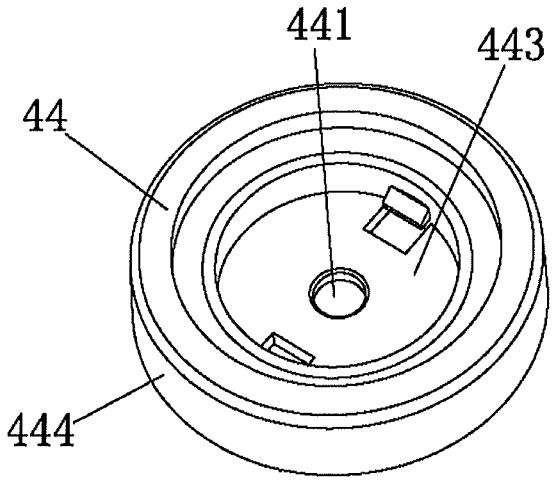
FIG. 11 and FIG. 12 are perspective views of a second embodiment of the knob of the helmet massager when being viewed from two viewing angles respectively.
Figure 12:
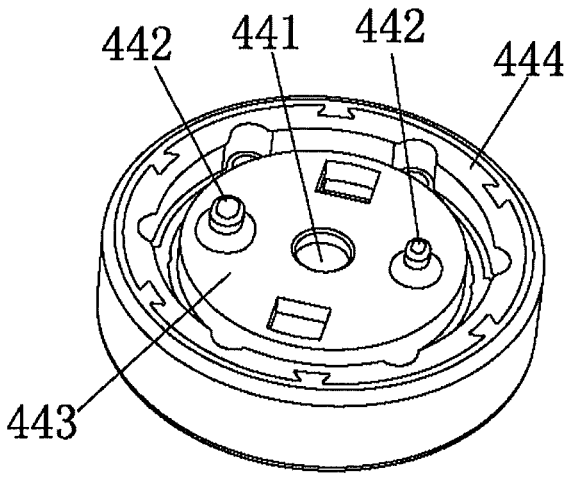
Figure 13:
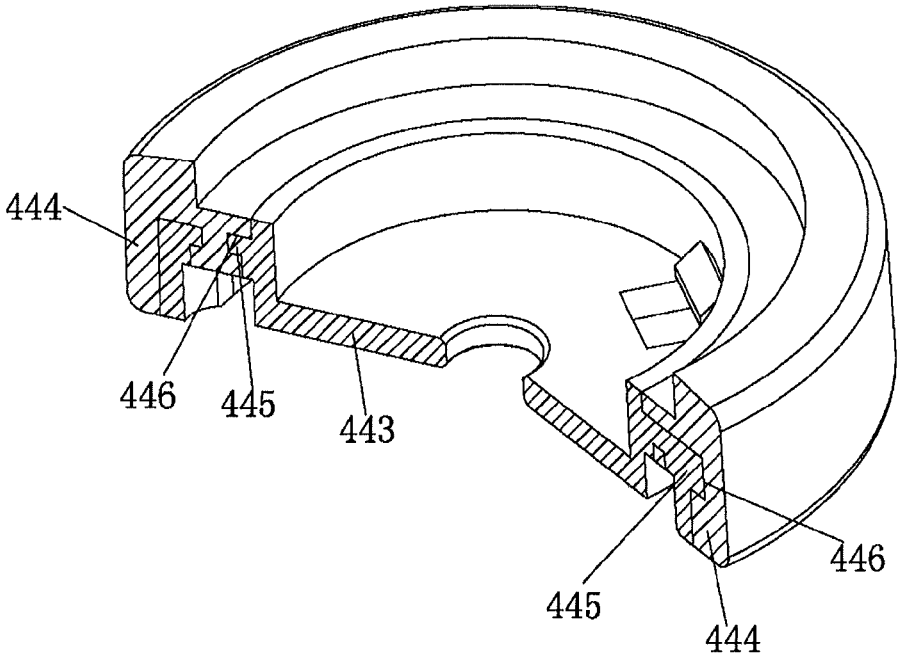
FIG. 13 is a schematic sectional view of the second embodiment of the knob of the helmet massager.
Figure 14:
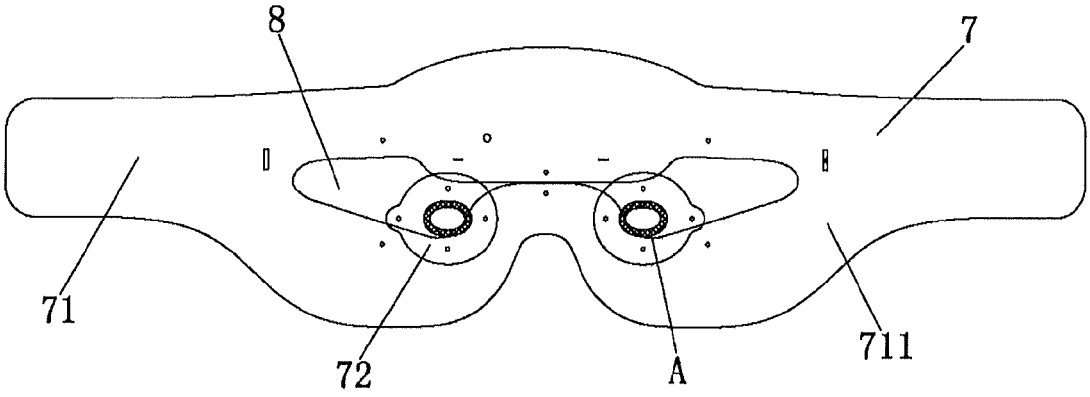
FIG. 14 is a schematic structure view of a cloth cover of the helmet massager.
Figure 15:
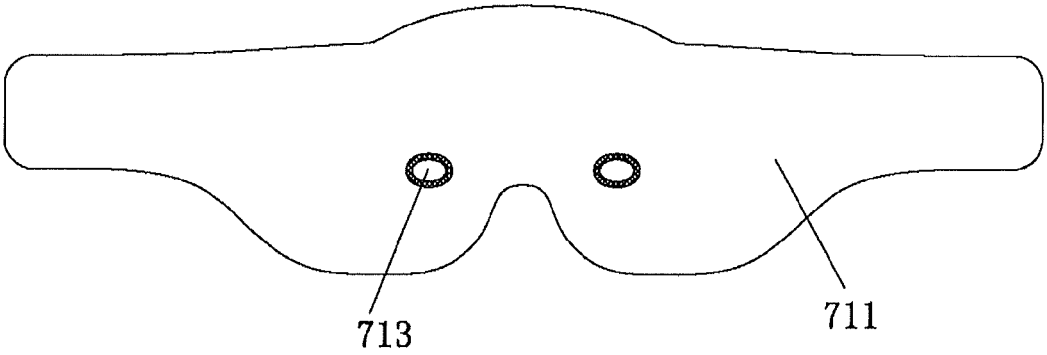
FIG. 15 is a schematic structure view of a cloth cover body of the helmet massager.
Figure 16:
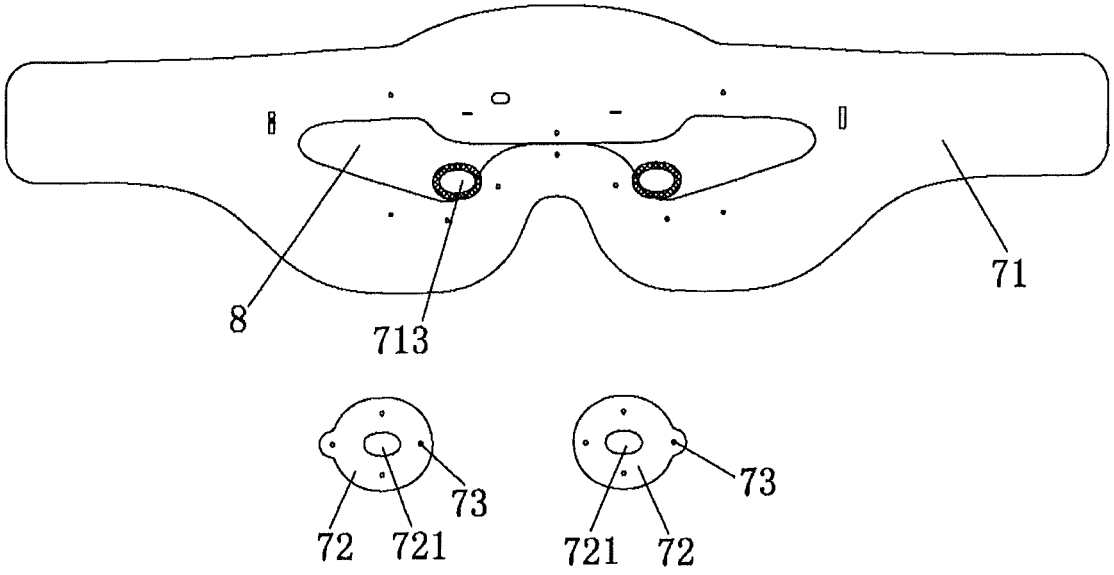
FIG. 16 is an exploded view of the cloth cover of the helmet massager.
Figure 17:
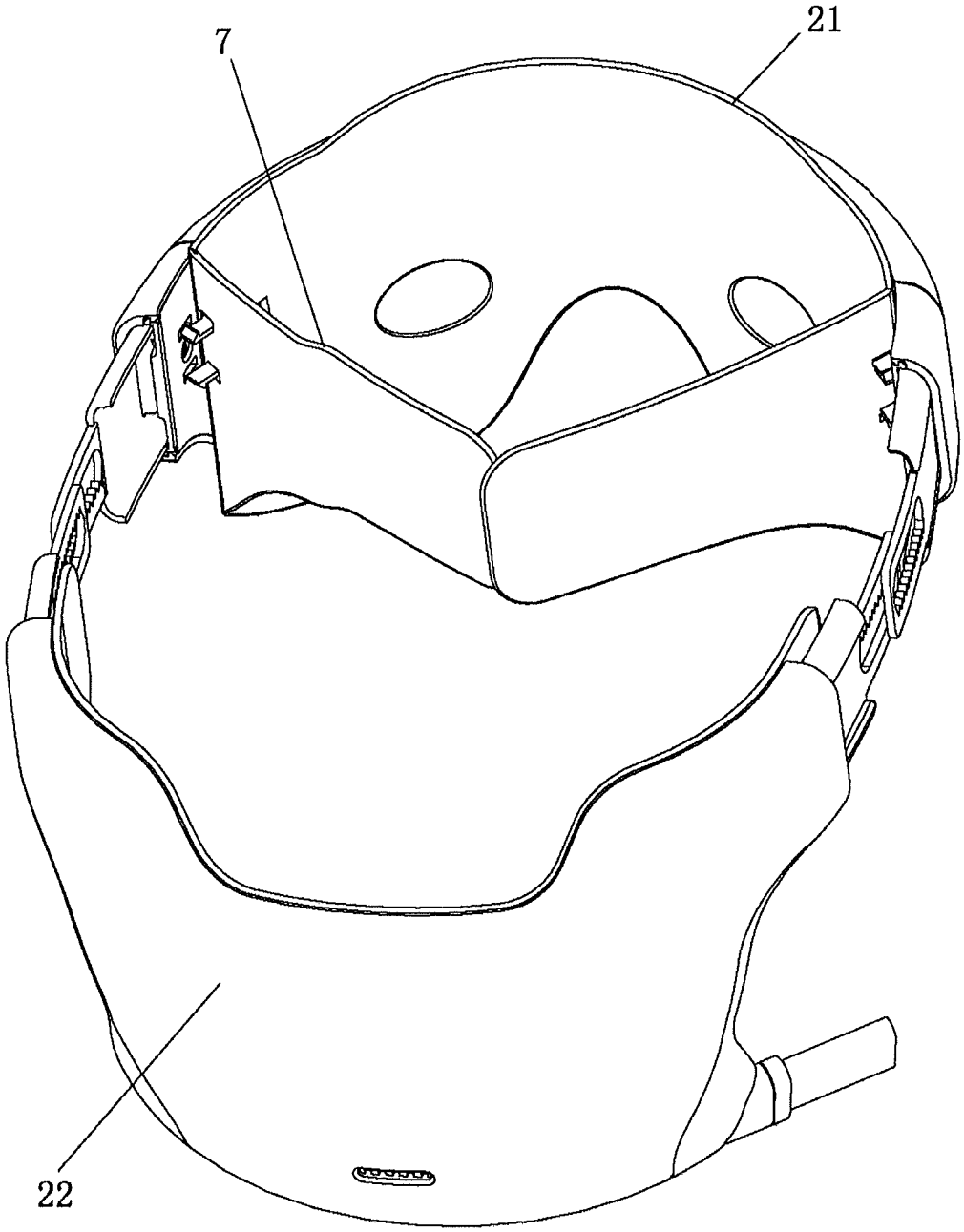
FIG. 17 is a schematic structure view of a second embodiment of the helmet massager.
Figure 18:
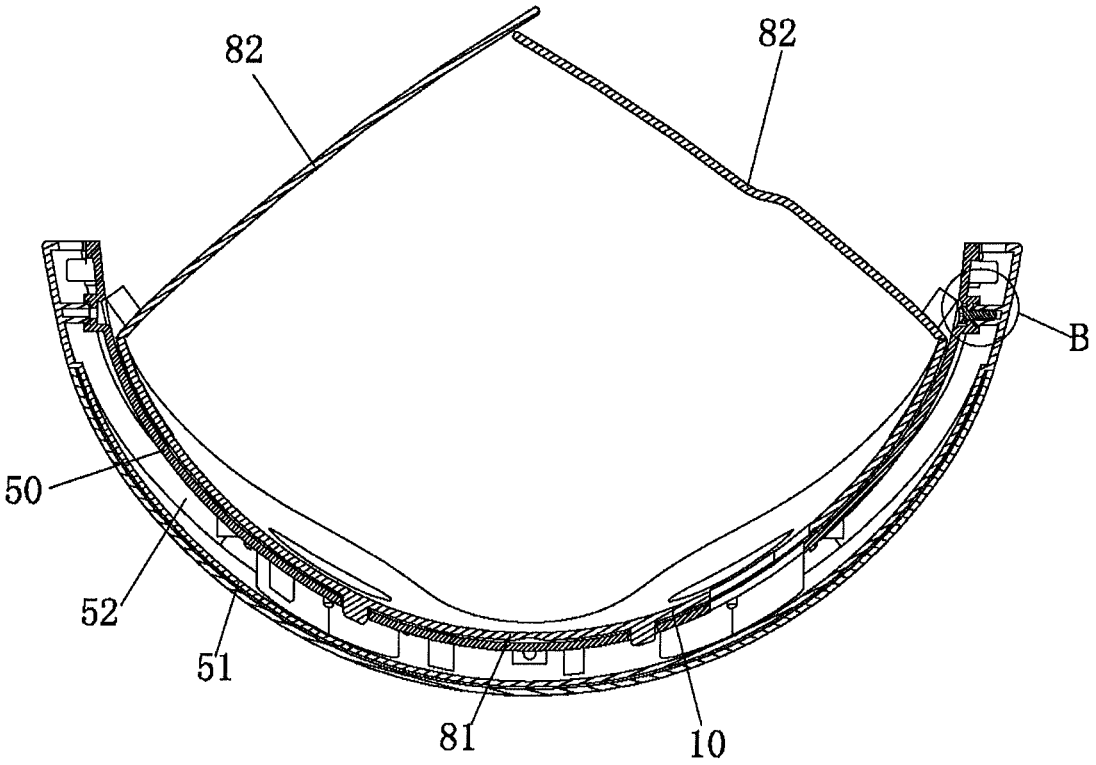
FIG. 18 is a schematic sectional view of the second embodiment of the helmet massager (the cloth cover is folded)
Figure 19:
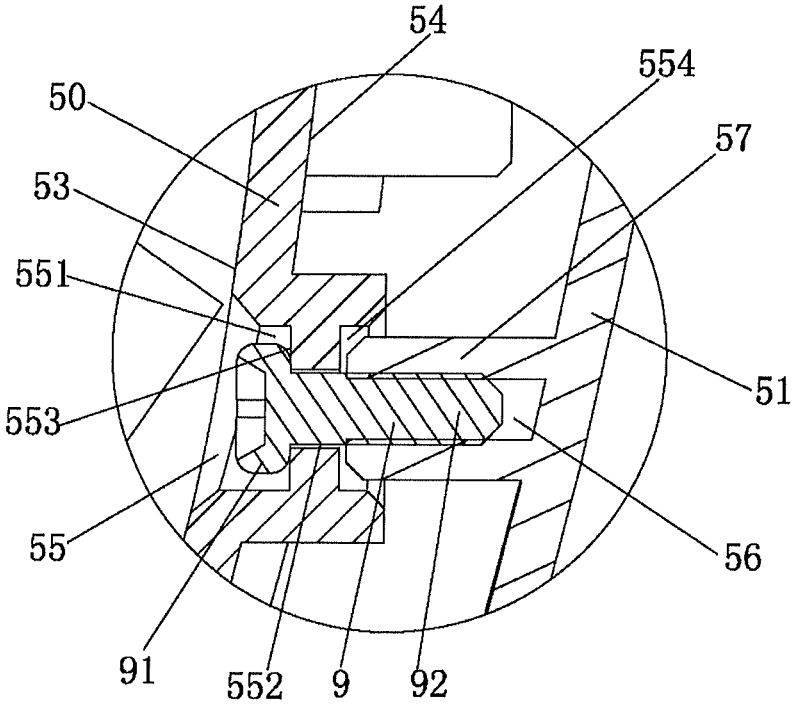
FIG. 19 is a partial enlarged view of a part pointed by B in FIG. 18.
Figure 20:
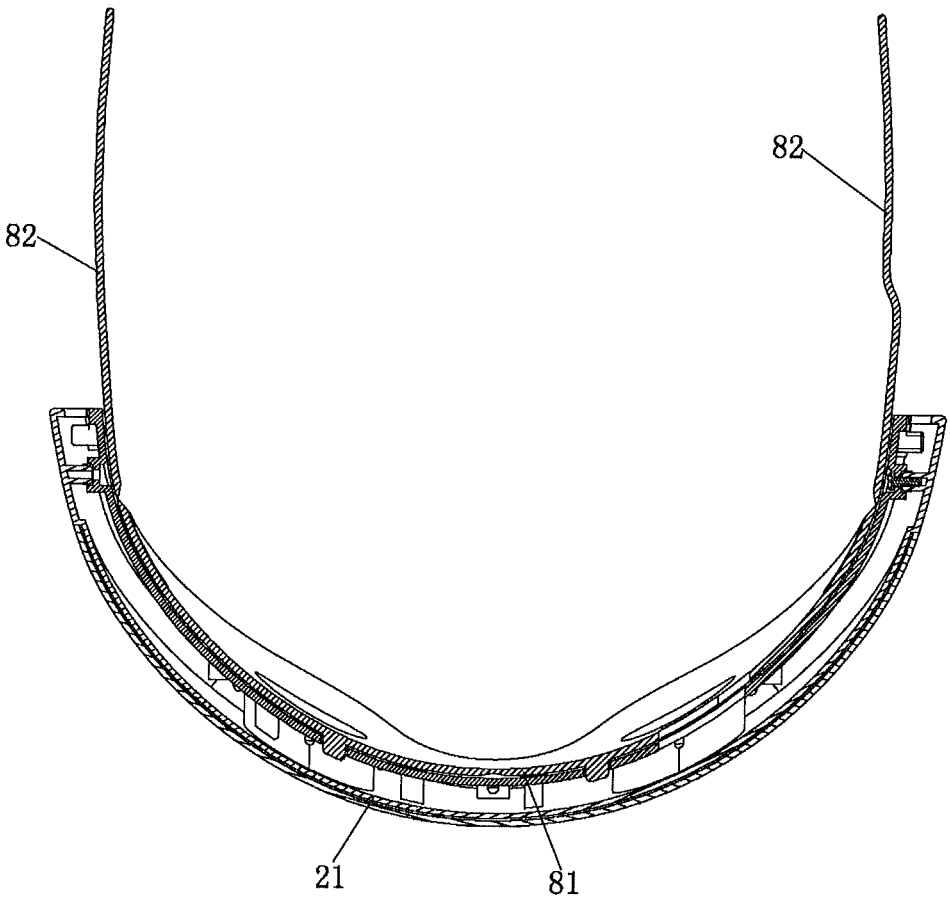
FIG. 20 is a schematic sectional view of the second embodiment of the helmet massager (the cloth cover is unfolded).

As shown in FIG. 8, when it is desired to adjust a size of the head room, the knob 44 is turned in a forward direction so that the knob 44 drives the ratchet body 43 and the gear 42 to rotate and the gear 42 drives the first left rack 212 and the first right rack 222 to move linearly; and in this way, the first left helmet body 21 and the first right helmet body 22 move close to each other to reduce the head room 5. In this adjusting process, the first bevel 437 of each of the ratchet teeth interacts with the second bevel 416 of the locking teeth so that the elastic arm 432 of the ratchet body is stressed to deform and the ratchet teeth 436 are disengaged from the locking teeth 415. As shown in FIG. 9, when the knob 44 is turned in a reverse direction, the knob 44 drives the ratchet body 43 via the poke rods 442 to rotate and the ratchet body 43 in turn drives the gear 42 to rotate so that the gear 42 drives the first left rack 212 and the first right rack 222 to move linearly; and in this way, the first left helmet body 21 and the first right helmet body 22 move away from each other to increase the head room 5. In this adjusting process, the elastic arm 432 is stressed to deform and the ratchet teeth 436 are disengaged from the locking teeth 415. As shown in FIG. 10, when the knob 44 is not turned, the ratchet teeth 436 engage with the locking teeth 415 so that the gear 42 cannot rotate. When the head room is adjusted to be maximum or minimum, each of the poke rods 442 abuts against an extreme position of the corresponding one of the adjusting grooves 434; and when the knob is not turned, the poke rods 442 are generally located in the middle of the adjusting grooves 434 respectively. In the process of turning in a first direction (the clockwise direction or the counterclockwise direction), after the poke rods 442 abut against the extreme positions at a side of the adjusting grooves 434 respectively, if the knob is continued to be turned in the first direction, then the knob drives the ratchet body and the gear to rotate synchronously; and if the knob is continued to be turned in a direction opposite to the first direction, then the knob idles for a certain angle and only after each of the poke rods move to an extreme position at the other side of one of the adjusting grooves, drives the ratchet body and the gear to rotate synchronously.

The second helmet body 3 is also adjustable and comprises a second left helmet body 31 and a second right helmet body 32 which are butt jointed. A second left butt joint end of the second left helmet body has a second left rack, and a second right butt-joint end of the second right helmet body has a second right rack. The second left butt-joint end and the second right butt-joint end can be butt jointed by means of a second adjusting device 6, and the second adjusting device 6 has the same structure as that of the aforesaid first adjusting device 4. The base 41 of the second adjusting device has the butt-joint space 413, and the second left butt-joint end and the second right butt-joint end are inserted into the butt joint space from a left side and a right side respectively. The gear of the second adjusting device engages with both the second left rack and the second right rack, and the knob of the second adjusting device drives the gear via the ratchet body to rotate. When the knob is turned in the forward direction or the reverse direction, the gear drives the second left helmet body and the second right helmet body to move linearly. A second left installing end of the second left helmet body is fixed to the base body of the first adjusting device disposed on the first helmet body, and a second right installing end of the second right helmet body is fixed to the base body of the first adjusting device disposed on the first helmet body.

As shown in FIG. 4 and FIG. 11 to FIG. 13, the knob 44 comprises a knob body 443 and a knob cover 444. The knob body 443 has the axle hole 441 through which the rotary shaft 45 passes, and is provided with two poke rods 442 at a side facing the ratchet body 43. The knob cover 444 is closely disposed around the knob body 443 in the circumferential direction and is injection molded into one piece with the knob body 443. To enhance the joining strength between the knob body 443 and the knob cover 444, the knob body 443 is formed with a circular protrusion 445, and the knob cover 444 is correspondingly formed with a circular groove 446 in which the protrusion 445 is embedded.

Both the knob body and the knob cover may be made of a plastic material. The knob cover may have a hardness that is smaller than that of the knob body (i.e., the knob cover may be softer) to increase the friction damping during the turning operation of a user and provide a good operation feel. The knob cover may be made of a soft rubber, or any other material that can provide a larger friction damping during operation.

The knob cover may be formed with a groove and the knob body is correspondingly formed with a protrusion; alternatively, the knob cover may be formed with a protrusion and the knob body is formed with a groove; and alternatively, both the knob cover and the knob body may be formed with a protrusion and a groove. The knob cover may be formed with one or more protrusions or grooves thereon; and correspondingly, the knob body is formed with one or more grooves or protrusions thereon. The protrusion may be a ring, a block or any other structure that can be engaged, and the groove matches the protrusion. The protrusion and the groove can be more strongly joined with each other through the engagement therebetween.

The knob can be used on the adjusting device of the aforesaid helmet massager for adjusting the size of the helmet, and can also be used on any other adjusting device that adjusts the size of the helmet by turning the knob.

As shown in FIG. 1, FIG. 2 and FIG. 14 to FIG. 16, a cloth cover 7 is installed on an inner side of the first left helmet body 21 of the first helmet body, and the inner side is a side of the first left helmet body facing ocular regions of the user. The cloth cover 7 may be used to cover an air bladder 8. Expansion or contraction of the air bladder will bring along expansion or contraction of the cloth cover, and thus the ocular regions of the user are massaged by the air pressure. The cloth cover comprises a cloth cover body 71 and linings 72, and the cloth cover body 71 has an inner cover 711 facing the user and an outer cover (not shown) opposite to the inner cover. An edge of the outer cover can be integrally sewn up with an edge of the inner cover to form the cloth cover body. A hollow portion (not shown) exists between the inner cover and the outer cover. The inner cover 711 is formed with two through-holes 713 running therethrough, and the two through-holes 713 correspond to two eyeballs of the user respectively. There are two linings 72, which are disposed at the two through-holes 713 respectively. The linings 72 may be made of a cloth. Each of the linings 72 has an opening 721 running therethrough so that the lining 72 forms a ring, an edge of the opening is sewn up with an edge of one of the through-holes, and the lining 72 may be located within the hollow portion. Each of the through-holes may correspond to two linings, and edges of openings of the two linings are sewn up with the edge of the through-hole to form a sewn site A. Through the cloth cover, the eyeballs of the user can be avoided from being massaged to effectively protect the eyes, accomplishing a comfortable and safe massage; and the operation is made simpler by sewing up the edges of the openings through the linings.

Additionally, the cloth cover 7 can cover a plastic supporting plate having a supporting function (i.e., the supporting plate can be entirely disposed within the hollow portion of the cloth cover body), and the air bladder can be supported by the supporting plate. The supporting plate is formed with installing holes corresponding to the linings. Each of the linings can be filled in one of the installing holes and installed on the supporting plate through cooperation of a locating hole 73 on the lining and a locating post of the supporting plate; and in this way, the supporting plate can be clamped by the linings and the inner cover. The cloth cover body and the linings can be assembled in advance, so when the supporting plate is to be assembled, it is only necessary to cover the supporting plate with the cloth cover body and position the linings on the supporting plate, thereby simplifying the installing process.

The cloth cover can not only be used on the aforesaid helmet massager, but also be used on a massager that has any other shape and structure and provides air pressure massage by means of an air bladder.

As shown in FIG. 17 to FIG. 20, the first left helmet body 21 may comprise an inner shell 50 and an outer shell 51, an installing cavity 52 is formed between the inner shell 50 and the outer shell 51, and an air pipe, a wire and the like of the helmet massager can be deployed within the installing cavity. The inner shell 50 has an inner surface 53 facing the user and an outer surface 54 facing the outer shell. The inner shell further has a via hole 55 running through the inner surface and the outer surface. The outer shell 51 has a screw hole 56 which may be a blind hole. A screw 9 is inserted through the via hole 55 and then locked into the screw hole 56 so that the inner shell and the outer shell are integrally fastened to form the first left helmet body of the entirety.

The via hole 55 may be a stepped hole and comprises a first hole 551 having a larger aperture and a second hole 552 having a smaller aperture, and a stepped surface 553 is formed between the first hole and the second hole. The screw 9 comprises a head 91 having a larger diameter and a bolt 92 having a smaller diameter, the diameter of the bolt is no larger than the aperture of the first hole and larger than the aperture of the second hole, and a diameter of the bolt is no larger than the aperture of the first hole. After the screw is locked, the head of the screw abuts against the stepped surface of the inner shell. As the screw is provided at a side of the inner shell, the outer shell facing the user is made artistic and neat.

To facilitate positioning of the inner shell and the outer shell in the installing process, the stepped hole may further comprise a third hole 554 having an aperture larger than that of the second hole, and the first hole, the second hole and the third hole are arranged and run into one another sequentially. The outer shell has a locating post 57 projected from an inner surface thereof facing the inner shell, and the screw hole is formed in the locating post. During installation, the locating post is inserted into the third hole.

After the inner shell, the outer shell and the screw are assembled, the head of the screw may not project from the inner surface of the inner shell but be completely located within the stepped hole; and the bolt of the screw may also not project from the outer surface of the outer shell.

The inner shell is further provided with a foldable cloth cover on the inner surface thereof, and the cloth cover is covered on a plastic supporting plate 10, which can be used to support the air bladder in the cloth cover. The supporting plate 10 comprises a fixed portion 81 and two foldable portions 82, the fixed portion 81 is fixed to the inner shell, and the two foldable portions 82 are disposed at two ends of the fixed portion 81 respectively and can be folded relative to the fixed portion 81. Through the bendable supporting plate 10, the screw can be kept away when the cloth cover, the inner shell and the outer shell are assembled, thereby facilitating installation of the screw from a side of the inner shell.

The structure with the screw installed at a side of the inner shell can not only be used on the aforesaid helmet body, but also be used on a housing of a massage apparatus having any other shape and structure.

The helmet massager may comprise a massage device disposed on the helmet, for example a device for providing vibrating massage using a vibrating motor, a device for providing massage using a hot compress or a cold compress, a device for providing massage using a magnetic force, and a device for providing massage using expansion and contraction of an air bladder which are currently available. The helmet massager may further comprise a control device, which may be disposed on the helmet and may also be disposed independently from the helmet. The control device controls the massage device in a wired or wireless way to work.

The helmet massager may massage such parts as the head, ocular regions and acupoints.

For the helmet massager, the helmet comprises the first helmet body and the second helmet body which are connected with each other. The first helmet body may be covered on the head on the head circumference, and the second helmet body is covered on the top of the head. Alternatively, the first helmet body may be covered on the top of the head, and the second helmet body is covered on the head circumference. The helmet may also comprise only a portion covered on the head circumference or only a portion covered on the top of the head. Shapes of the first helmet body and the second helmet body may be made according to design requirements.

In the case that both the first helmet body and the second helmet body exist, it is possible that only one of the first helmet body and the second helmet body is provided with an adjusting device or that both the first helmet body and the second helmet body are provided with an adjusting device respectively.

The helmet massager comprises a helmet, and the helmet comprises a first helmet body. The first helmet body comprises a first left helmet body and a first right helmet body which are butt jointed. The first left helmet body and the first right helmet body respectively have a first left butt-joint end and a first right butt-joint end. The first left butt-joint end and the first right butt-joint end respectively have a first left rack and a first right rack. The helmet further comprises an adjusting device. The adjusting device comprises a base, a gear, a ratchet body with ratchet teeth, and a knob for driving the ratchet body to rotate. The base is located at a butt-joint site of the first left helmet body and the first right helmet body. Each of the first left rack and the first right rack engages with the gear. The ratchet body is positioned on the gear. The knob is mounted on the ratchet body. The base has a ring of locking teeth. The ratchet body has a locked state and an unlocked state. When the ratchet body is in the locked state, the ratchet teeth engage with the locking teeth, and when the ratchet body is in the unlocked state, the ratchet teeth are disengaged from the locking teeth.

The first left butt-joint end is an end of the first left helmet body that is to be butt jointed with the first right helmet body, and the first right butt-joint end is an end of the first right helmet body that is to be butt jointed with the first left helmet body. When the first helmet is covered on the head circumference, the first left helmet body and the first right helmet body preferably have two first left butt-joint ends and two first right butt-joint ends respectively and there are two adjusting device correspondingly (i.e., the two first left butt-joint ends are butt jointed with the two first right butt-joint ends through the two adjusting device respectively). When the first helmet is covered on the top of the head, the first left helmet body and the first right helmet body have one first left butt-joint end and one first right butt-joint end respectively and there is one adjusting device correspondingly.

The ratchet body has an elastic portion which is deformed when being stressed, and the ratchet teeth are formed on the elastic portion. The elastic portion is like an elastic arm cantilevering from the body of the ratchet body; and of course, the elastic portion may also be any other structure that can be deformed when being stressed.

The knob is installed on the ratchet body, and may be fixed to the ratchet body. Alternatively, the knob is provided with a poke rod thereon and the ratchet body is correspondingly formed with an adjusting groove thereon, within which the poke rod slides. Of course, it is also possible that the knob is formed with an adjusting groove thereon and the ratchet body is correspondingly provided with a poke rod thereon. The knob may be installed on the ratchet body in two ways, i.e., directly or via an additional element, and both of the ways can have the knob drive the ratchet body to rotate.

By positioning of the ratchet body on the gear, it may mean that the ratchet body is positioned on the gear directly or the ratchet body is positioned relative to the gear via an additional element so that the ratchet body and the gear can rotate synchronously. The positioning is accomplished, for example, by providing a snapping post on the ratchet body and correspondingly providing a snapping groove on the gear or, of course, by providing a snapping groove on the ratchet body and correspondingly providing a snapping post on the gear, and the number of the snapping post and the number of the snapping groove may be designed according to design requirements. The positioning may also be accomplished through fixed connection or in any other way that can make the ratchet body and the gear rotate synchronously.

The present invention has been further detailed in the above descriptions with reference to the preferred embodiments; however, it shall not be construed that implementations of the present invention are only limited to these descriptions. Many simple deductions or replacements may further be made by those of ordinary skill in the art without departing from the conception of the present invention, and all of the deductions or replacements shall be considered to be covered within the protection scope of the present invention.

The invention claimed is:

1. A helmet massager comprising:

a helmet, the helmet comprising:

a first helmet body, wherein the first helmet body comprises a first left helmet body and a first right helmet body which are butt jointed, the first left helmet body and the first right helmet body respectively have a first left butt-joint end and a first right butt- joint end, the first left butt-joint end and the first right butt-joint end respectively have a first left rack and a first right rack; and an adjusting device, the adjusting device comprising a base, a gear, a ratchet body with ratchet teeth, and a knob for driving the ratchet body to rotate, wherein the base is located at a butt-joint site of the first left helmet body and the first right helmet body, each of the first left rack and the first right rack engages with the gear, the ratchet body is positioned on the gear, the knob is mounted on the ratchet body, the base has a ring of locking teeth, the ratchet body has a rotating state and a rest state, when the ratchet body is in the rest state, the ratchet teeth engage with the locking teeth, and when the ratchet body is in the rotating state, the ratchet teeth are disengaged from the locking teeth, and the gear is formed with a snapping groove at a side facing the ratchet body, the ratchet body is provided with a snapping post at a side facing the gear, and the snapping post is snap-fitted into the snapping groove.

2. The helmet massager of claim 1, wherein the ratchet body comprises a body and an elastic arm cantilevering from the body and having an elasticity, and the ratchet teeth are disposed on the elastic arm.

3. The helmet massager of claim 2, wherein each of the ratchet teeth has a first bevel, and each of the locking teeth has a second bevel matching the first bevel.

4. The helmet massager of claim 1, wherein one of the knob and the ratchet body has a poke rod, the other one of the knob and the ratchet body has an arcuate adjusting groove, the poke rod extends into the adjusting groove, and the poke rod has an outer diameter that is less than a length of the adjusting groove.

5. The helmet massager of claim 1, wherein the adjusting device further comprises a rotary shaft axially positioned on the base, and the gear, the ratchet body and the knob are all disposed around the rotary shaft.

6. The helmet massager of claim 1, wherein the knob comprises a knob body and a knob cover, the knob cover is disposed around and fixedly and integrally connected with the knob body, and the knob cover is made of a soft rubber.

7. The helmet massager of claim 6, wherein the knob cover and the knob body are injection molded into one piece.

8. The helmet massager of claim 7, wherein the knob cover and the knob body engage with each other by means of a groove and a protrusion.

9. The helmet massager of claim 1, wherein the first left helmet body comprises an inner shell, an outer shell and a screw, the inner shell comprises a via hole, the outer shell comprises a screw hole, and the screw is inserted through the via hole and then locked into the screw hole.

10. The helmet massager of claim 9, wherein the via hole has a stepped surface, against which a head of the screw abuts.

11. The helmet massager of claim 10, wherein the outer shell comprises a locating post in which the screw hole is located, and the locating post is inserted into the via hole.

12. The helmet massager of claim 9, wherein the inner shell is fixedly provided with a cloth cover and a supporting plate, the cloth cover covers the supporting plate, the supporting plate comprises a fixed portion and two foldable portions, the fixed portion is fixed to the inner shell, the two foldable portions are disposed at two ends of the fixed portion respectively, the fixed portion is integrally connected with the foldable portions, and the foldable portions are capable of bending relative to the fixed portion.

13. The helmet massager of claim 1, wherein the ratchet body and the gear rotate synchronously and the ring of locking teeth of the base surrounds a rotation axis of the gear.

14. The helmet massager of claim 1, wherein the helmet further comprises a second helmet body disposed on the first helmet body.

15. The helmet massager of claim 1, wherein the base comprises a base body and an enclosure, the base body and the enclosure are fixedly connected with each other to enclose a butt-joint space, and the first left butt-joint end and the first right butt-joint end are inserted into the butt-joint space from a left side and a right side respectively.

16. A helmet massager comprising:

a helmet, the helmet comprising:

a first helmet body, wherein the first helmet body comprises a first left helmet body and a first right helmet body which are butt jointed, the first left helmet body and the first right helmet body respectively have a first left butt-joint end and a first right butt-joint end, the first left butt-joint end and the first right butt-joint end respectively have a first left rack and a first right rack; and an adjusting device, the adjusting device comprising a base, a gear, a ratchet body with ratchet teeth, and a knob for driving the ratchet body to rotate, wherein the base is located at a butt-joint site of the first left helmet body and the first right helmet body, each of the first left rack and the first right rack engages with the gear, the ratchet body is positioned on the gear, the knob is mounted on the ratchet body, the base has a ring of locking teeth, the ratchet body has a rotating state and a rest state, when the ratchet body is in the rest state, the ratchet teeth engage with the locking teeth, and when the ratchet body is in the rotating state, the ratchet teeth are disengaged from the locking teeth, and wherein the first left helmet body is provided with a cloth cover on an inner side thereof, the cloth cover comprises a cloth cover body and linings, the cloth cover body is covered with an air bladder, the cloth cover body has through-holes corresponding to a user's eyeballs, each of the linings has an opening corresponding to one of the through-holes, and an edge of each of the openings is sewn up with an edge of one of the through-holes.

17. The helmet massager of claim 16, wherein the linings are located inside the cloth cover body.

18. A helmet massager comprising a helmet, the helmet comprising a first helmet body and a second helmet body connected across the first helmet body, wherein the first helmet body comprises a first left helmet body and a first right helmet body which are butt jointed, the second helmet body comprises a second left helmet body and a second right helmet body which are butt jointed, each of the first left helmet body, the first right helmet body, the second left helmet body and the second right helmet body has a butt-joint end, each of the butt-joint ends has a rack, two adjacent butt-joint ends are butt jointed by means of an adjusting device, the adjusting device comprises a base, a gear, a ratchet body and a knob for driving the ratchet body to rotate, the base is located at a butt-joint site of two adjacent butt-joint ends, each of the racks of the two adjacent butt-joint ends engages with the gear, the ratchet body is positioned on the gear, the ratchet body has an elastic portion which is deformed when being stressed, the elastic portion is formed with ratchet teeth, the knob is mounted on the ratchet body, the base has a ring of locking teeth, the ratchet body has a rotating state and a rest state, when the ratchet body is in the rest state, the ratchet teeth engage with the locking teeth, and when the ratchet body is in the rotating state, the locking teeth deform the elastic portion so that the ratchet teeth are disengaged from the locking teeth.

19. The helmet massager of claim 18, wherein the ratchet body comprises a body and an elastic arm cantilevering from the body and having an elasticity, and the ratchet teeth are disposed on the elastic arm.

20. The helmet massager of claim 19, wherein each of the ratchet teeth has a first bevel, and each of the locking teeth has a second bevel matching the first bevel.

21. The helmet massager of claim 18, wherein one of the knob and the ratchet body has a poke rod, the other one of the knob and the ratchet body has an arcuate adjusting groove, the poke rod extends into the adjusting groove, and the poke rod has an outer diameter that is less than a length of the adjusting groove.

* * * * *